US011198029B2

(12) United States Patent
Spelman

(10) Patent No.: US 11,198,029 B2
(45) Date of Patent: Dec. 14, 2021

(54) REFORMER CARRIAGE DRAG ADJUSTMENT APPARATUS

(71) Applicant: Balanced Body, Inc., Sacramento, CA (US)

(72) Inventor: Kit W. Spelman, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 107 days.

(21) Appl. No.: 16/723,101

(22) Filed: Dec. 20, 2019

(65) Prior Publication Data

US 2020/0121969 A1 Apr. 23, 2020

Related U.S. Application Data

(63) Continuation of application No. PCT/US2018/045342, filed on Aug. 6, 2018.
(Continued)

(51) Int. Cl.
*A63B 21/00* (2006.01)
*A63B 22/00* (2006.01)
*A63B 22/20* (2006.01)

(52) U.S. Cl.
CPC .... *A63B 21/00069* (2013.01); *A63B 21/4045* (2015.10); *A63B 22/0089* (2013.01); *A63B 22/203* (2013.01)

(58) Field of Classification Search
CPC ..... A63B 21/00058; A63B 21/00069; A63B 21/012; A63B 21/0125; A63B 21/015;
(Continued)

(56) References Cited

U.S. PATENT DOCUMENTS 5,779,600 A * 7/1998 Pape ..... A63B 22/0012 482/72
6,045,491 A * 4/2000 McNergney ..... A63B 21/153 482/121

(Continued)

FOREIGN PATENT DOCUMENTS

EP 0788761 B1 5/2000

OTHER PUBLICATIONS

International Search Report and Written Opinion, dated Jan. 10, 2019, from International Patent App. No. PCT/US2018/045342.

*Primary Examiner* — Joshua Lee
*Assistant Examiner* — Catrina A Letterman
(74) *Attorney, Agent, or Firm* — Greenberg Traurig, LLP

(57) ABSTRACT

A reformer includes a generally rectangular frame, a movable carriage mounted on the frame for movement between head end and foot end of the frame, and a plurality of springs biasing the carriage toward the foot end of the frame. The carriage has at least four roller wheels. A carriage drag adjustment device in accordance with the present disclosure generally includes a drag generator configured to apply an opposing force to at least one roller wheel of the wheeled reformer carriage, a mounting assembly fastening the drag generator to the wheeled reformer carriage, and an adjustment mechanism coupled to the drag generator to adjust the amount of drag applied to at least one roller wheel mounted to an underside of the reformer carriage, thereby opposing movement of the wheeled reformer carriage between the head and foot ends of the frame.

15 Claims, 2 Drawing Sheets

Related U.S. Application Data

(60) Provisional application No. 62/542,214, filed on Aug. 7, 2017.

(58) Field of Classification Search
CPC ..... A63B 22/0087–0089; A63B 22/20–208; A63B 22/0076–2022/0079
See application file for complete search history.

(56) References Cited

U.S. PATENT DOCUMENTS

| | | | | |
|---|---|---|---|---|
| 7,104,937 | B2 | 9/2006 | Arbuckle et al. | |
| 8,500,614 | B2 | 8/2013 | Rooks | |
| 2001/0056011 | A1* | 12/2001 | Endelman | A63B 22/0087 482/121 |
| 2003/0195095 | A1 | 10/2003 | Endelman et al. | |
| 2012/0000718 | A1 | 1/2012 | Berrett et al. | |
| 2013/0017935 | A1* | 1/2013 | Endelman | A63B 21/156 482/131 |
| 2017/0106222 | A1* | 4/2017 | Mayer | A63B 22/0605 |
| 2018/0369643 | A1* | 12/2018 | Huang | A63B 21/015 |

* cited by examiner

REFORMER CARRIAGE DRAG ADJUSTMENT APPARATUS

CROSS-REFERENCE TO RELATED APPLICATION

This application is a continuation of International Patent Application No. PCT/US2018/045342, filed Aug. 6, 2018, which claims benefit of priority to U.S. Patent Application No. 62/542,214, filed Aug. 7, 2017, each of which is incorporated herein by reference in its entirety.

BACKGROUND OF THE DISCLOSURE

The present disclosure is directed to exercise equipment and more particularly to a drag adjustment mechanism for a wheeled reformer carriage.

A reformer is an exercise apparatus first developed by Joseph H. Pilates in the last century. A typical reformer has a rectangular frame and a wheeled carriage riding back and forth on rails typically attached along or integral with the sides of the frame. The carriage is biased toward a foot end of the frame usually by one or more coil springs and has a generally flat cushioned upper surface. The carriage is structured to support a user's body in a sitting, standing or reclining position and has four roller wheels, one at each corner, that ride on the rails. These roller wheels are typically made of a hard plastic material and have internal sets of ball bearings riding on a rigid shaft, similar to skateboard wheels.

Historically many reformers have had carriages with somewhat softer wheels than those that are currently being marketed today. In such traditional reformers, the softer wheels deform slightly under load. This deformation presents as an additional drag that a user experiences when pushing or pulling against the resistance provided by the coil springs. Thus when a light person reclines or sits on the older reformer carriage, the wheel drag together with the coil springs provide a certain resistance to the user pushing or pulling the carriage away from the foot end of the reformer frame, which differs from the resistance that a heavy person on the same reformer carriage experiences with the same spring settings.

In contrast, current reformer designs are such that substantially the only resistance that a user experiences during exercise is that provided by the combination of springs selected and hooked between the carriage and the foot end of the reformer frame. In order for a user to gain the same sensory experience as with one of the traditional reformers when exercising on a current reformer, there is a need for a former carriage configuration that ensures the user obtains the same experience during exercise. Furthermore, while reformers typically utilize 5 or six springs each with a predetermined spring rate, it may be advantageous to provide an augmented resistance for the user to experience during certain exercises, which permits a fine tuning of the total resistance experience.

SUMMARY OF THE DISCLOSURE

The present disclosure is directed to exercise equipment and more particularly to a drag adjustment mechanism for a wheeled reformer carriage. A reformer carriage drag adjustment device in accordance with one aspect of the present disclosure includes a drag generator and a mounting assembly fastening the drag generator to the wheeled reformer carriage. The drag generator may be configured to apply an opposing force to at least one roller wheel of a wheeled reformer carriage. Furthermore, the drag generator may be coupled to at least one of the plurality of roller wheels mounted to an underside of the wheeled reformer carriage, thereby opposing movement of the wheeled reformer carriage. The drag generator may be configured to apply a drag (i.e., an opposing force) on a roller wheel of the wheeled reformer carriage via one or more of a frictional force and an electromagnetic force.

In accordance with one aspect of the present disclosure, a drag generator is provided comprising a toggle clamp. The toggle clamp may include a rod, an adjustment device coupled to a first end of the rod, a hinging mechanism coupled to a second end of the rod, and a friction applicator coupled to the hinging mechanism. The toggle clamp may be operable to move the friction applicator toward and away from one of the plurality of roller wheels to apply a friction force against the roller wheel, thereby generating a drag on the wheeled reformer carriage. In one embodiment, the rod is a threaded rod. In one embodiment, the adjustment device is a knob. Other suitable adjustment devices may be used, such as, for instance, a handle.

In one aspect of the present disclosure, the hinging mechanism is configured to move the friction applicator toward and away from the roller wheel via the adjustment device. The friction applicator may comprise a plunger, a pad block fastened to the distal end of the plunger, and a sheet pad fastened to a face of the pad block to contact the roller wheel. The sheet pad may contact a roller wheel to apply a friction force on the roller wheel, thereby generating a drag on the wheeled reformer carriage. The sheet pad may be made of any suitable material, such as a polymeric material (e.g., polyethylene). The hinging mechanism may comprise a carrier sleeve mounted on the rod, a pin fixed to the carrier sleeve, and a stem portion comprising a closed slot. The pin may be captured in the closed slot. Furthermore, the stem portion may be attached to the proximal end of the frictional applicator. In one embodiment, the closed slot is milled lengthwise through the stem portion. In one embodiment, the carrier sleeve is mounted on the rod adjacent the stem portion of the toggle clamp. In one embodiment, the rod is a threaded rod, and the threaded rod threadably engages the carrier sleeve.

The mounting assembly may be configured to be rigidly attached to the platform of the wheeled reformer carriage. For instance, in one embodiment, a mounting assembly comprises an L shaped plate. The L shaped plate may comprise a vertical leg portion and a horizontal leg portion. The vertical leg portion of the L shaped plate may be configured to support the toggle clamp. Furthermore, the L shaped plate may be spaced from the roller wheel. In one embodiment, the horizontal leg portion is configured to extend downward in front of the roller wheel. In one embodiment, the horizontal leg portion is configured to extend toward a head end of the reformer exercise apparatus, and parallel to the platform. In one embodiment, the horizontal leg portion of the L shaped plate supports the rod. In one embodiment, the adjustment device, rod, and hinging mechanism are configured to push the friction applicator through the vertical leg portion toward and away from the roller wheel to apply the friction force against the roller wheel.

In another aspect in accordance with the present disclosure, a reformer carriage drag adjustment device kit for retrofitting a reformer exercise apparatus is disclosed. The kit may comprise at least one drag generator configured to apply an opposing force to at least one roller wheel of a wheeled reformer carriage, and a mounting assembly for fastening the drag generator to the wheeled reformer carriage and for coupling the drag generator to at least one of a plurality of roller wheel assemblies mounted to an underside of the wheeled reformer carriage, thereby opposing movement of the wheeled reformer carriage.

In another aspect in accordance with the present disclosure, a reformer exercise apparatus is disclosed, the reformer exercise comprising at least one drag generator coupled to at least one of the roller wheels for generating a drag on the wheeled carriage. In this regard, the reformer exercise apparatus generally comprises a generally rectangular frame having a pair of parallel spaced side rail portions, a head end portion, and a foot end portion, a wheeled carriage supported by the side rail portions for movement of the carriage between the head and foot end portions, a plurality of roller wheels mounted to an underside of the wheeled carriage, a bias member connected between the wheeled carriage and the foot end portion of the frame for biasing the wheeled carriage toward the foot end of the frame, and a foot support member supported by the generally rectangular frame.

In another aspect in accordance with the present disclosure, a method of changing a variable rolling resistance of a wheeled reformer carriage on a reformer exercise apparatus is disclosed. In this regard, the method may comprise the operations of: providing a reformer exercise apparatus having a generally rectangular frame and a wheeled carriage on the frame for movement back and forth between side rails of the frame, providing a reformer carriage drag adjustment device fastened to the carriage adjacent to at least one of a plurality of roller wheels mounted to an underside of the wheeled carriage, generating a drag on the least one of the plurality of roller wheels via the drag adjustment device and adjusting the reformer carriage drag adjustment device, thereby changing the rolling resistance of the wheeled reformer carriage as a user moves the carriage back and forth between the head and foot ends of the reformer frame.

DETAILED DESCRIPTION

Figure 1:
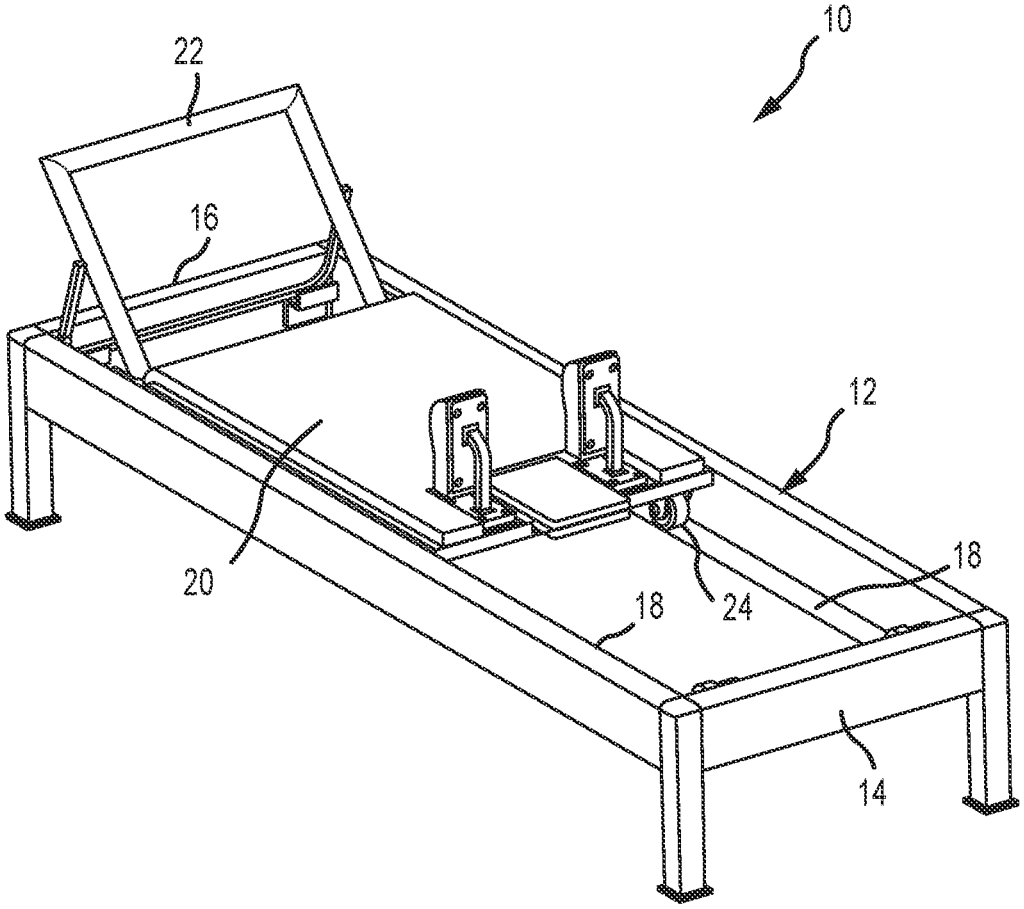
FIG. 1 is a perspective view of a conventional reformer exercise apparatus.

A typical reformer exercise apparatus is shown in FIG. 1. The reformer exercise apparatus 10 includes a generally rectangular frame 12 having a head end 14, a foot end 16, a pair of rails 18 between the head and foot end that may form part of the frame 12, a movable carriage 20 mounted on the rails 18 for movement between the head and foot ends 14 and 16 along the rails 18, a foot support assembly 22 adjacent the foot end 16 for a user to push against to move the carriage 20, and a plurality of bias members (not shown) attached between the foot end 16 of the frame 12 and the carriage 20 biasing the carriage 20 toward the foot end 16 of the reformer frame 12. This carriage 20 typically has four roller wheels 24 that ride on the upper surface of the rails 18 and four guide roller wheels (not shown) that roll along sides of the rails 18 to maintain lateral alignment of the carriage 20 between the rails 18.

Figure 2:
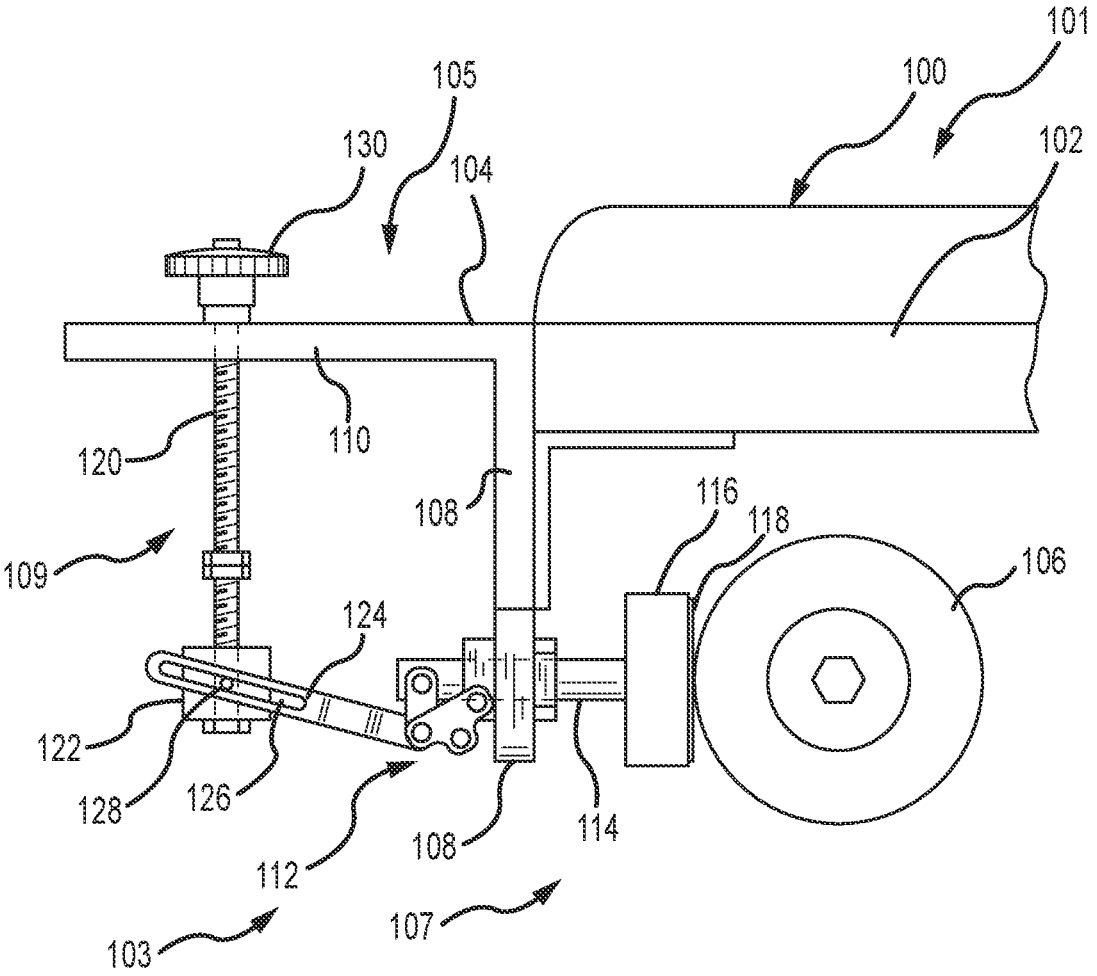
FIG. 2 is a side view of one exemplary embodiment of a drag adjustment apparatus for a carriage of a reformer exercise apparatus in accordance with the present disclosure.

A head end corner of a reformer carriage 100 is shown in a partial side view in FIG. 2. The reformer carriage 100 includes a cushioned platform 102 that is rollably supported on the rails via at least four roller wheels 106. A reformer carriage drag adjustment device 101 in accordance with one aspect of the present disclosure includes a drag generator 103 and a mounting assembly 105 fastening the drag generator 103 to the wheeled reformer carriage 100. In this exemplary embodiment the mounting assembly 105 includes an L shaped plate 104 is bolted or otherwise rigidly attached to the platform 102 above and spaced from one carriage roller wheel 106. The L shaped plate 104 has a vertical leg portion 108 that extends downward in front of the wheel 106. A horizontal leg portion 110 extends toward a head end of the reformer parallel to the platform 102. The vertical leg portion 108 in this embodiment supports a toggle clamp 112 that is operable to move a friction applicator 107 that includes a plunger 114 through the leg portion 108 toward and away from the roller wheel 106. A suitable toggle clamp is conventionally available from McMaster-Carr Supply Company, item #5093A56. A pad block 116 is fastened to the distal end of the plunger 114. A sheet pad 118 of UHMW polyethylene is fastened to the face of the pad block 116 so as to contact the wheel 106 when the plunger 114 is pushed through the leg portion 108 toward the wheel 106.

The horizontal leg portion 110 of the plate 104 supports an adjustment device 109 including a threaded rod 120 that threadably engages a carrier sleeve 122 mounted on the threaded rod 120 adjacent a stem portion 124 of the toggle clamp 112. A closed slot 126 is milled lengthwise through the stem portion 124. The carrier sleeve 122 has a pin 128 that is captured in the slot 126. When the threaded rod 120 of the adjustment device 109 is turned clockwise by the knob 130 as viewed from above the carrier sleeve 122 is raised on the rod 120. This action pushes the plunger 114 of friction applicator 107 in the clamp 112 through the leg portion 108 toward the wheel 106 and applies a friction force against the wheel 106 to generate a drag on the carriage. Reversing direction of turn of the knob 130 of the adjustment device 109 oppositely withdraws the plunger 114 such that the pad 118 reduces the frictional force against wheel 106 until the pad 118 no longer contacts the wheel 106. In this arrangement very fine control of the resistance applied to the wheel 106 can be realized.

There are numerous other devices that can be utilized to perform the function of the toggle clamp. The toggle clamp is simply one mechanism that can be utilized to apply a frictional force to the wheel 106 to generate a drag on carriage movement. Other suitable mechanisms to apply a frictional force to the wheel 106 may be used. For instance, the application of a frictional force via a disc and caliper assembly may be used (e.g., similar to a disc brake assembly for a bike wheel or car wheel). In this regard, such an assembly may include an external concentric disc attached to the wheel 106, and a set of calipers configured to externally straddle the concentric disc. The set of calipers may apply the frictional force to the concentric disc (e.g., via a toggle) via caliper pads. Furthermore, the application of a frictional force via an endless belt assembly may be used (e.g., similar to a belt-driven stationary bike). In this regard, such an assembly may include a sub-wheel (e.g., a sub-axle) attached to the wheel 106, where the sub-wheel comprises a recessed portion configured to receive a belt. The belt may be wrapped around the recessed portion of the sub-wheel and may be rotatably fixed to the reformer carriage 100. The frictional force may be generated via the contact of the belt with the sub-wheel during rotation of the wheel 106. To adjust the amount of frictional force, the belt may be configured with an adjustment device (e.g., a toggle).

The above described mechanisms for generating a drag on the carriage include the application of a frictional force. However, other forces, such as a magnetic force may be used to the same effect. For instance, a magnetic force may be used to generate an opposing force on the carriage via an electromagnetic brake and electrical power supply assembly (e.g., DC or AC power). The electrical power supply may supply electrical current to the electromagnetic brake to generate the drag (i.e., the opposing force), similar to the frictional force of the toggle clamp mechanism described above. Since the user of the reformer will move the carriage back-and-forth during exercise, the assembly may be configured to alternate the direction of the opposing force, such that the electromagnetic brake applies an opposing force on the carriage throughout the entirety of the exercise. Furthermore, an assembly of this sort may allow for the amount of drag to be adjusted via the amount of electrical power delivered to the electromagnetic brake. For instance, the amount of drag may be determined and delivered to the carriage as a function of the user's weight. In this regard, the amount of electrical power delivered to the electromagnetic brake may be adjusted via a controller connected to the assembly. The controller may be configured with an adjustment device that allows the user to adjust the amount of drag generated. An adjustment device may be, for instance, a digital display and adjustment mechanism (e.g., buttons, knobs), or a wireless device (e.g., a remote, a smartphone) configured to wirelessly communicate with the controller, among others.

Many variations of the present disclosure are envisioned. For example, the drag adjustment device 101 shown in FIG. 2 may be applied across two head or foot end roller wheels of the carriage 100. Alternatively the device 101 may be configured to put a drag on the guide wheels that roll along vertical walls of the rails of the reformer frame (not shown). All such changes, alternatives and equivalents in accordance with the features and benefits described herein, are within the scope of the present disclosure. Any or all of such changes and alternatives may be introduced without departing from the spirit and broad scope of this disclosure.

The invention claimed is:

1. A reformer carriage drag adjustment device comprising:

a drag generator configured to apply an opposing force to at least one roller wheel of a wheeled reformer carriage; and a mounting assembly fastening the drag generator to the wheeled reformer carriage;

wherein the drag generator is coupled to at least one of a plurality of roller wheels mounted to an underside of the wheeled reformer carriage, thereby opposing movement of the wheeled reformer carriage, the drag generator comprising a toggle clamp, wherein the toggle clamp comprises:

(a) a rod;

(b) an adjustment device coupled to a first end of the rod;

(c) a hinging mechanism coupled to a second end of the rod; and (d) a friction applicator coupled to the hinging mechanism;

wherein the toggle clamp is operable to move the friction applicator toward and away from the at least one roller wheel to apply a friction force against the at least one roller wheel, thereby generating a drag on the wheeled reformer carriage.

2. The reformer carriage drag adjustment device of claim 1, wherein the friction applicator comprises:

(a) a plunger;

(b) a pad block fastened to a distal end of the plunger; and (c) a sheet pad fastened to a face of the pad block to contact the at least one roller wheel.

3. The reformer carriage drag adjustment device of claim 2, wherein the hinging mechanism comprises:

(a) a carrier sleeve mounted on the rod;

(b) a pin fixed to the carrier sleeve;

(c) a stem portion comprising a closed slot;

wherein the pin is captured in the closed slot;

wherein the stem portion is attached to a proximal end of the friction applicator; and wherein the hinging mechanism is configured to move the friction applicator toward and away from the at least one roller wheel via the adjustment device.

4. The reformer carriage drag adjustment device of claim 3, wherein the mounting assembly comprises an L shaped plate comprising a vertical leg portion and a horizontal leg portion, and wherein the vertical leg portion of the L shaped plate is configured to support the toggle clamp.

5. The reformer carriage drag adjustment device of claim 4, wherein:

the L shaped plate is rigidly attached to a platform of the wheeled reformer carriage; and the L shaped plate is spaced from the one of the at least one wheel.

6. The reformer carriage drag adjustment device of claim 5, wherein the adjustment device, rod, and hinging mechanism are configured to push the friction applicator through the vertical leg portion of the L shaped plate to apply the friction force against the at least one roller wheel.

7. A reformer exercise apparatus comprising:

a rectangular frame having a pair of parallel spaced side rail portions, a head end portion, and a foot end portion;

a wheeled carriage supported by the side rail portions for movement of the carriage between the head and foot end portions;

a plurality of roller wheels mounted to an underside of the wheeled carriage;

a bias member connected between the wheeled carriage and the foot end portion of the frame for biasing the wheeled carriage toward the foot end of the frame;

a foot support member supported by the generally rectangular frame; and at least one drag generator coupled to at least one of the plurality of roller wheels for generating a drag force against rotation of the at least one of the plurality of roller wheels mounted to the underside of the wheeled carriage wherein the drag generator comprises a toggle clamp, and wherein the toggle clamp comprises:

(a) a rod;

(b) an adjustment device coupled to a first end of the rod;

(c) a hinging mechanism coupled to a second end of the rod; and (d) a friction applicator coupled to the hinging mechanism;

wherein the toggle clamp is operable to move the friction applicator toward and away from one of the plurality of roller wheels to apply a friction force against the at least one of the plurality of roller wheels, thereby generating a drag on the wheeled reformer carriage.

8. The reformer exercise apparatus of claim 7, wherein the friction applicator comprises:

(a) a plunger;

(b) a pad block fastened to a distal end of the plunger; and (c) a sheet pad fastened to a face of the pad block to contact the at least one of the plurality of roller wheels.

9. The reformer exercise apparatus of claim 8, wherein the hinging mechanism comprises:

(a) a carrier sleeve mounted on the rod;

(b) a pin fixed to the carrier sleeve;

(c) a stem portion comprising a closed slot;

wherein the pin is captured in the closed slot; and wherein the stem portion is attached to a proximal end of the friction applicator; and wherein the hinging mechanism is configured to move the friction applicator toward and away from the one of the plurality of roller wheels via the adjustment device.

10. A reformer carriage drag adjustment device kit for retrofitting a reformer exercise apparatus, the kit comprising:

at least one drag generator configured to apply an opposing force to against rotation of at least one roller wheel of a wheeled reformer carriage;

a mounting assembly for fastening the drag generator to the wheeled reformer carriage and for coupling the drag generator to at least one of a plurality of roller wheel assemblies mounted to an underside of the wheeled reformer carriage, wherein the drag generator comprises a toggle clamp kit, and wherein the toggle clamp kit comprises:

(a) a rod;

(b) an adjustment device for coupling to a first end of the rod;

(c) a hinging mechanism for coupling to a second end of the rod; and (d) a friction applicator for coupling to the hinging mechanism;

wherein the toggle clamp kit is configured to be operable to move the friction applicator toward and away from one of the plurality of roller wheels to apply a friction force against the one of the plurality of roller wheels, thereby generating a drag on the wheeled reformer carriage.

11. The reformer carriage drag adjustment device kit of claim 10, wherein the friction applicator comprises:

(a) a plunger;

(b) a pad block for fastening to a distal end of the plunger; and (c) a sheet pad for fastening to a face of the pad block for contacting the one of the plurality of roller wheels.

12. The reformer carriage drag adjustment device kit of claim 11, wherein the hinging mechanism comprises:

(a) a carrier sleeve for mounting on the rod;

(b) a pin fixed to the carrier sleeve;

(c) a stem portion comprising a closed slot;

wherein the pin is configured to be captured in the closed slot; and wherein the stem portion is configured to be attached to a proximal end of the friction applicator; and wherein the hinging mechanism is configured for moving the friction applicator toward and away from the one of the plurality of roller wheels via the adjustment device.

13. The reformer carriage drag adjustment device kit of claim 12, wherein the mounting assembly comprises an L shaped plate comprising a vertical leg portion and a horizontal leg portion, and wherein the vertical leg portion of the L shaped plate is configured for supporting the toggle clamp.

14. The reformer carriage drag adjustment device kit of claim 13, wherein:

the L shaped plate is configured for rigidly attaching to a platform of the wheeled reformer carriage; and the L shaped plate is configured to be spaced from at least one of the plurality of roller wheels.

15. The reformer carriage drag adjustment device kit of claim 14, wherein the adjustment device, rod, and hinging mechanism are configured for pushing the friction applicator through the vertical leg portion of the L shaped plate.

* * * * *